US010839728B2

(12) United States Patent
Zhang et al.

(10) Patent No.: US 10,839,728 B2
(45) Date of Patent: Nov. 17, 2020

(54) CIRCUIT AND METHOD FOR DETECTING SHORT CIRCUIT OF COMMON ELECTRODE WIRING

(71) Applicant: Shenzhen China Star Optoelectronics Technology Co.,Ltd., Guangdong (CN)

(72) Inventors: Xianming Zhang, Guangdong (CN); Dan Cao, Guangdong (CN)

(73) Assignee: SHENZHEN CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 171 days.

(21) Appl. No.: 15/749,486

(22) PCT Filed: Jan. 2, 2018

(86) PCT No.: PCT/CN2018/070041
§ 371 (c)(1),
(2) Date: Nov. 6, 2018

(87) PCT Pub. No.: WO2019/109440
PCT Pub. Date: Jun. 13, 2019

(65) Prior Publication Data

US 2020/0135071 A1 Apr. 30, 2020

(30) Foreign Application Priority Data

Dec. 5, 2017 (CN) ..... 2017 1 1266026

(51) Int. Cl.
*G09G 3/00* (2006.01)
*G09G 3/36* (2006.01)

(52) U.S. Cl.
CPC ..... *G09G 3/006* (2013.01); *G09G 3/3648* (2013.01); *G09G 2330/021* (2013.01); *G09G 2330/025* (2013.01); *G09G 2330/04* (2013.01)

(58) Field of Classification Search
CPC ..... G09G 3/006; G09G 3/3648; G09G 2330/021; G09G 2330/025;
(Continued)

(56) References Cited

U.S. PATENT DOCUMENTS

2012/0127213 A1* 5/2012 Park ..... G09G 3/006 345/690
2014/0084792 A1* 3/2014 Oh ..... G09G 3/00 315/120
(Continued)

FOREIGN PATENT DOCUMENTS

CN 106026009 A 10/2016
CN 106980420 A 7/2017

OTHER PUBLICATIONS

Zhang Xianming; Overcurrent protection circuit for power manager, and display panel equipped with overcurrent protection circuit; Publication CN106026009A•Oct. 12, 2016; Shenzhen China Star Optoelect;H02H3/08 (Specification) (Year: 2016).*
(Continued)

*Primary Examiner* — Nasima Monsur
(74) *Attorney, Agent, or Firm* — Hemisphere Law, PLLC; Zhigang Ma

(57) ABSTRACT

A circuit for detecting a short circuit of a common electrode wiring is applied in an LCD panel and includes a common electrode wiring, a short circuit determination module and a resistor. An output terminal of the common electrode wiring is connected with a first terminal of the resistor and an input terminal of the short circuit determination module, and a second terminal of the resistor is connected with an input terminal of the short circuit determination module. The short circuit determination module obtains a voltage drop signal according to a first signal outputted by the common electrode wiring and a second signal from the resistor in a blanking period of the LCD panel, and determines that the
(Continued)

common electrode wiring has a short circuit if the voltage value of the voltage drop signal is greater than the voltage value of a reference signal throughout a predetermined period.

15 Claims, 1 Drawing Sheet

(58) Field of Classification Search
CPC ..... G09G 2330/04; G09G 2330/12; G09G 3/3655; G01R 31/08
See application file for complete search history.

(56) References Cited

U.S. PATENT DOCUMENTS

2014/0333204 A1* 11/2014 Zhang ..... H05B 45/46 315/119
2017/0115812 A1* 4/2017 Lin ..... G02F 1/13338

OTHER PUBLICATIONS

Zhang Xianming; Overcurrent protection circuit for power manager, and display panel equipped with overcurrent protection circuit; Publication CN106026009A•Oct. 12, 2016; Shenzhen China Star Optoelect;H02H3/08 (Claims and Figure) (Year: 2016).*

* cited by examiner

CIRCUIT AND METHOD FOR DETECTING SHORT CIRCUIT OF COMMON ELECTRODE WIRING

RELATED APPLICATIONS

The present application is a National Phase of International Application Number PCT/CN2018/070041, filed Jan. 2, 2018, and claims the priority of China Application No. 201711266026.0, filed Dec. 5, 2017.

FIELD OF THE DISCLOSURE

The present invention relates to a display technology field, and more particularly, to a circuit and a method for detecting a short circuit of a common electrode wiring.

BACKGROUND

One problem of the current process of manufacturing a thin film transistor-liquid crystal display (TFT-LCD) penal (hereinafter LCD panel) that often occurs is that the internal circuit has a short circuit, and thus the circuit internal of the LCD panel to needs to be detected to determine whether a short circuit exists. Currently, a short circuit protection process of VCOM wirings (i.e. common electrode wirings in the LCD panel) is that currents of the VCOM wirings in the LCD panel are detected in each period. However, in the scanning period of each frame, the VCOM wirings would receive interferences from the data lines and the gate lines internal of the LCD panel and would be affected by the drain currents of the TFTs in the LCD panel, which results in a large variation of the short circuit current on the VCOM wirings. Therefore, the above method of detecting whether the circuit internal of the LCD panel has a short circuit has low detecting accuracy. In this method, a short circuit can be detected to trigger over current protection (OCP) only when the current of the short circuit is considerably large.

SUMMARY

To solve the aforementioned technical problem, the present invention provides a circuit and a method for detecting a short circuit of a common electrode wiring, which can increase the accuracy of detecting a short circuit to the circuits internal of the LCD panel. Even if the current of a short circuit internal of the LCD panel is relatively small, such short circuit internal of the LCD panel can also be detected.

A circuit for detecting a short circuit of a common electrode wiring provided by the present invention is applied in an LCD panel and includes a power management integrated circuit and a first resistor; the power management integrated circuit includes a common electrode wiring and a short circuit determination module.

An output terminal of the common electrode wiring is connected with a first terminal of the first resistor and an input terminal of the short circuit determination module, and a second terminal of the first resistor is connected with an input terminal of the short circuit determination module.

The short circuit determination module is configured to perform a difference processing on a first voltage signal outputted by the common electrode wiring and a second voltage signal from the first resistor to obtain a voltage drop signal in a blanking period of the LCD panel and to compare the voltage drop signal with a first reference voltage signal; if a voltage value of the voltage drop signal is greater than a voltage value of the first reference voltage signal throughout a predetermined period, the short circuit determination module determines that the common electrode wiring has a short circuit.

The second voltage signal is outputted by the first voltage signal via the first resistor.

In one embodiment, the short circuit determination module includes a subtraction unit, a comparison unit and a switching unit.

The subtraction unit is connected with the comparison unit via the switching unit, the subtraction unit is configured to receive the first voltage signal and the second voltage signal, and is configured to perform a difference processing on the first voltage signal and the second voltage signal, so as to obtain the voltage drop signal, and output the voltage drop signal to the comparison unit.

The switching unit is configured to connect the subtraction unit with the comparison unit according to an enable signal in the blanking period of the LCD panel and to disconnect the subtraction unit from the comparison unit in a scanning period of the LCD panel.

The comparison unit is configured to compare the voltage drop signal with the first reference voltage signal; if the voltage value of the voltage drop signal is less than or equal to the voltage value of the first reference voltage signal, the comparison unit determines that the common electrode wiring has no short circuit; if the voltage value of the voltage drop signal is greater than the voltage value of the first reference voltage signal throughout the predetermined period, the comparison unit determines that the common electrode wiring has a short circuit.

In one embodiment, the comparison unit includes a first comparator, a second comparator, a second resistor and a capacitor.

An output terminal of the first comparator is connected with a first terminal of the capacitor and the second comparator via the second resistor, a second terminal of the capacitor is grounded, and an input terminal of the first comparator is connected with the subtraction unit via the switching unit.

The first comparator is configured to compare the voltage drop signal with the first reference voltage signal; if the voltage value of the voltage drop signal is less than or equal to the voltage value of the first reference voltage signal, the first comparator outputs a low level signal; if the voltage value of the voltage drop signal is greater than the voltage value of the first reference voltage signal, the first comparator outputs a third voltage signal of high level to charge the capacitor.

The second comparator is configured to compare a fourth voltage signal outputted by the capacitor with a second reference voltage signal; after the capacitor is charged in the predetermined period, if a voltage value of the fourth voltage signal is greater than a voltage value of the second reference voltage signal, the second comparator determines that the voltage value of the voltage drop signal is greater than the voltage value of the first reference voltage signal throughout the predetermined period and that the common electrode wiring has a short circuit.

In one embodiment, the short circuit determination module further includes a diode that is connected in parallel with the second resistor, and an anode of the diode is connected with the first terminal of the capacitor.

The subtraction unit is a subtractor.

In one embodiment, the switching unit is an N-channel TFT, and the enable signal is at high level in the blanking period of the LCD panel and is at low level in the scanning period of the LCD panel.

In one embodiment, the enable signal is outputted by an over-current protection circuit that is connected with the common electrode wiring.

In one embodiment, the predetermined period is at a range of 150 μs to 300 μs.

The present invention further provides a circuit for detecting a short circuit of a common electrode wiring. The circuit is applied in an LCD panel and includes a power management integrated circuit and a first resistor. The power management integrated circuit includes a common electrode wiring and a short circuit determination module.

An output terminal of the common electrode wiring is connected with a first terminal of the first resistor and an input terminal of the short circuit determination module, in which a second terminal of the first resistor is connected with an input terminal of the short circuit determination module.

The short circuit determination module is configured to perform a difference processing on a first voltage signal outputted by the common electrode wiring with a second voltage signal from the first resistor to obtain a voltage drop signal in a blanking period of the LCD panel and to compare the voltage drop signal with a first reference voltage signal; if a voltage value of the voltage drop signal is greater than a voltage value of the first reference voltage signal throughout a predetermined period, the short circuit determination module determines that the common electrode wiring has a short circuit.

The second voltage signal is outputted by the first voltage signal via the first resistor, and the predetermined period is at a range of 150 μs to 300 μs.

In one embodiment, the short circuit determination module includes a subtraction unit, a comparison unit and a switching unit.

The subtraction unit is connected with the comparison unit via the switching unit, the subtraction unit is configured to receive the first voltage signal and the second voltage signal, and is configured to perform a difference processing on the first voltage signal and the second voltage signal, so as to obtain the voltage drop signal, and output the voltage drop signal to the comparison unit.

The switching unit is configured to connect the subtraction unit with the comparison unit according to an enable signal in the blanking period of the LCD panel and to disconnect the subtraction unit from the comparison unit in a scanning period of the LCD panel.

The comparison unit is configured to compare the voltage drop signal with the first reference voltage signal; if a voltage value of the voltage drop signal is less than or equal to a voltage value of the first reference voltage signal, the comparison unit determines that the common electrode wiring has no short circuit; if the voltage value of the voltage drop signal is greater than the voltage value of the first reference voltage signal throughout the predetermined period, the comparison unit determines that the common electrode wiring has a short circuit.

In one embodiment, the comparison unit includes a first comparator, a second comparator, a second resistor and a capacitor.

An output terminal of the first comparator is connected with a first terminal of the capacitor and the second comparator via the second resistor, a second terminal of the capacitor is grounded, and an input terminal of the first comparator is connected with the subtraction unit via the switching unit.

The first comparator is configured to compare the voltage drop signal with the first reference voltage signal; if the voltage value of the voltage drop signal is less than or equal to the voltage value of the first reference voltage signal, the first comparator outputs a low level signal; if the voltage value of the voltage drop signal is greater than the voltage value of the first reference voltage signal, the first comparator outputs a third voltage signal of high level to charge the capacitor.

The second comparator is configured to compare a fourth voltage signal outputted by the capacitor with a second reference voltage signal; after the capacitor is charged in the predetermined period, if a voltage value of the fourth voltage signal is greater than a voltage value of the second reference voltage signal, the second comparator determines that the voltage value of the voltage drop signal is greater than the voltage value of the first reference voltage signal throughout the predetermined period and that the common electrode wiring has a short circuit.

In one embodiment, the short circuit determination module further includes a diode that is connected in parallel with the second resistor, and an anode of the diode is connected to the first terminal of the capacitor.

The subtraction unit is a subtractor.

In one embodiment, the switching unit is an N-channel TFT, and the enable signal is at high level in the blanking period of the LCD panel and is at low level in the scanning period of the LCD panel.

In one embodiment, the enable signal is outputted by an over-current protection circuit that is connected with the common electrode wiring.

The present invention further provides a method for detecting a short circuit of a common electrode wiring. The method includes the following steps.

A short circuit determination module receives a first voltage signal outputted by the common electrode wiring and a second voltage signal from the first resistor, and performs a difference processing on the first voltage signal and the second voltage signal to obtain a voltage drop signal, in which the second voltage signal is outputted by the first voltage signal via the first resistor.

In a blanking period of an LCD panel, the short circuit determination module comparing the voltage drop signal with a first reference voltage signal and determining that the common electrode wiring has a short circuit if a voltage value of the voltage drop signal is greater than a voltage value of the first reference voltage signal throughout a predetermined period includes the following steps.

In one embodiment, comparing the voltage drop signal with the first reference voltage signal in the blanking period of the LCD panel includes the following steps.

An enable signal is outputted to a switching unit that is connected between a subtraction unit and the first comparator, and the subtraction unit is connected with the first comparator by controlling the switching unit in the blanking period of the LCD panel.

The first comparator receives the voltage drop signal from the subtraction unit and compares the voltage drop signal with the first reference voltage signal; the first comparator outputs a low level signal if a voltage value of the voltage drop signal is smaller or equal to a voltage value of the first reference voltage signal; the first comparator outputs a third voltage signal of high level to charge a capacitor if the voltage value of the voltage drop signal is greater than the voltage value of the first reference voltage signal.

The second comparator compares a fourth voltage signal outputted by the capacitor with the second reference voltage signal; after the capacitor is charged in the predetermined period, the second comparator determines that the voltage value of the voltage drop signal is greater than the voltage value of the first reference voltage signal throughout the predetermined period and that the common electrode wiring has a short circuit if a voltage value of the fourth voltage signal is greater than a voltage value of the second reference voltage signal.

In one embodiment, the predetermined period is at a range of 150 μs to 300 μs.

The embodiments of the present invention have the following beneficial effects. In the embodiments of the present invention, the voltage drop value of the first voltage signal that is outputted from the output terminal of the common electrode wiring and through the first resistor is detected in the blanking period of the LCD panel, and then the voltage drop value is compared with the voltage value of the first reference voltage signal to determine if the voltage drop value is greater than the voltage value of the first reference voltage signal throughout the predetermined period; if yes, the common electrode wiring is determined to have a short circuit. In the embodiments of the present invention, the common electrode wiring is detected in the blanking period, such that interference on data lines and gate lines in the scanning period of the LCD panel and effects of drain currents of the TFTs in the LCD panel can be avoided. Therefore, when the common electrode wiring has a short circuit, a triggered over-current protection on the common electrode wiring can be accurately detected.

BRIEF DESCRIPTION OF THE DRAWINGS

Accompanying drawings are for providing further understanding of embodiments of the disclosure. The drawings form a part of the disclosure and are for illustrating the principle of the embodiments of the disclosure along with the literal description. Apparently, the drawings in the description below are merely some embodiments of the disclosure, a person skilled in the art can obtain other drawings according to these drawings without creative efforts. In the figures.

DETAILED DESCRIPTION OF PREFERRED EMBODIMENTS

Figure 1:
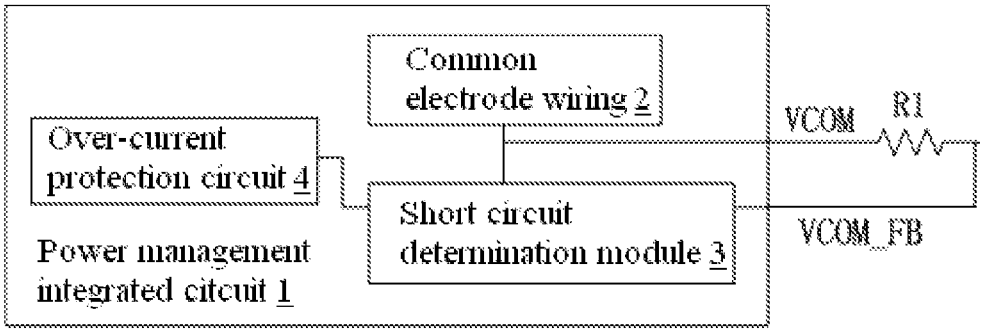
FIG. 1 is a block diagram of a circuit for detecting a short circuit of a common electrode wiring according to one embodiment of the present invention.

The present invention provides a circuit for detecting a short circuit of a common electrode wiring which is applied in an LCD panel. As shown in FIG. 1, the circuit includes a power management integrated circuit 1 and a first resistor R1. The power management integrated circuit 1 includes a common electrode wiring 2 and a short circuit determination module 3.

An output terminal of the common electrode wiring 2 is connected with a first terminal of the first resistor R1 and an input terminal of the short circuit determination module 3, and a second terminal of the first resistor R1 is connected with an input terminal of the short circuit determination module 3.

The short circuit determination module 3 is configured to perform a difference processing on a first voltage signal VCOM outputted by the common electrode wiring 2 and a second voltage signal VCOM_FB from the first resistor R1 to obtain a voltage drop signal V1 in a blanking period of the LCD panel and to compare the voltage drop signal V1 with a first reference voltage signal Vref1. If the voltage value of the voltage drop signal V1 is greater than the voltage value of the first reference voltage signal Vref1 throughout a predetermined period, the short circuit determination module 3 determines that the common electrode wiring 2 has a short circuit. The second voltage signal VCOM_FB is outputted by the first voltage signal VCOM via the first resistor R1. A voltage drop value of the voltage drop signal V1 is that of the first voltage signal VCOM after passing through the first resistor R1.

In general, the output terminal of the common electrode wiring 2 is connected with an RC filtering circuit, and the first resistor R1 may be the resistor of the RC filtering circuit. Here, the voltage value of the first reference voltage signal Vref1 may be determined according to the first resistor R1. For example, if a current value of a short circuit current of the common electrode wiring 2 to be detected is I, the voltage value of the first reference voltage signal Vref1 is U1 and the resistance of the first resistor R1 is R1, then U1=R1*I.

Figure 2:
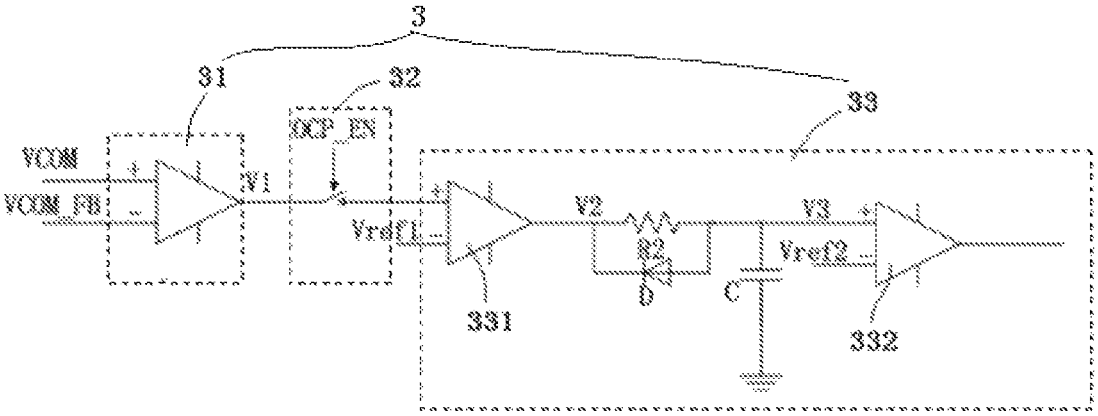
FIG. 2 is a circuit diagram of a short circuit determination module according to one embodiment of the present invention.

Furthermore, as shown in FIG. 2, a short circuit determination module 3 includes a subtraction unit 31, a comparison unit 33 and a switching unit 32.

The subtraction unit 31 is connected with the comparison unit 33 via the switching unit 32, the subtraction unit 31 is configured to receive the first voltage signal VCOM and the second voltage signal VCOM_FB, and is configured to perform a difference processing on the first voltage signal VCOM and the second voltage signal VCOM_FB, to obtain the voltage drop signal, and output the voltage drop signal V1 to the comparison unit 33. The subtraction unit 31 may be a subtractor, in which a positive input terminal receives the first voltage signal VCOM and a negative input terminal receives the second voltage signal VCOM_FB.

The switching unit 32 is configured to connect the subtraction unit 31 with the comparison unit 33 according to an enable signal OCP_EN in the blanking period of the LCD panel and to disconnect the subtraction unit 31 from the comparison unit 33 in a scanning period of the LCD panel.

The comparison unit 33 is configured to compare the voltage drop signal V1 with the first reference voltage signal Vref1. If the voltage value of the voltage drop signal V1 is less than or equal to the voltage value of the first reference voltage signal Vref1, the comparison unit 33 determines that the common electrode wiring 2 has no short circuit; if the voltage value of the voltage drop signal V1 is greater than the voltage value of the first reference voltage signal Vref1 throughout the predetermined period, the comparison unit determines that the common electrode wiring 2 has a short circuit.

Furthermore, as shown in FIG. 2, the comparison unit 33 includes a first comparator 331, a second comparator 332, a second resistor R2 and a capacitor C.

An output terminal of the first comparator 331 is connected with a first terminal of the capacitor C and the second comparator 332 via the second resistor R2, a second terminal of the capacitor C is grounded, and an input terminal of the first comparator 331 is connected with the subtraction unit 31 via the switching unit 32.

A positive input terminal of the first comparator 331 receives the voltage drop signal V1, while a negative input terminal of the first comparator 331 receives the first reference voltage signal Vref1. The first comparator 331 is configured to compare the voltage drop signal V1 with the first reference voltage signal Vref1. If the voltage value of the voltage drop signal V1 is less than or equal to the voltage value of the first reference voltage signal Vref1, then the first comparator 331 outputs a low level signal, the common electrode wiring 2 has no short circuit, and no over-current protection is triggered; if the voltage value of the voltage drop signal V1 is greater than the voltage value of the first reference voltage signal Vref1, the first comparator 331 outputs a third voltage signal V2 of high level to charge the capacitor C. The first comparator 331 charges the capacitor C via the second resistor R2, which may reduce the current outputted to the capacitor C, such that the charge rate of the third voltage signal V2 to the capacitor C is reduced to prevent from an instantaneous fully charging the capacitor C instantaneously, thereby avoiding the second comparator 332 from not being to determine whether an over-current protection for the common electrode wiring 2 is triggered by a short circuit or based on a spike that may cause false triggering.

A voltage value of a second reference voltage signal Vref2 may be determined according to the predetermined period, the capacitor C, the second resistor R2 and the third voltage signal V2. For example, if the predetermined period is t and the voltage value of the third voltage signal V2 is U0, then the voltage value U of the second reference voltage signal Vref2 is U0*(1−exp(−t/RC)), where R is the resistance of the second resistor R2 and C is a capacitance of the capacitor C.

The second comparator 332 is configured to compare a fourth voltage signal V3 outputted by the capacitor C with a second reference voltage signal Vref2. After the capacitor C is charged in the predetermined period, if a voltage value of the fourth voltage signal V3 is greater than a voltage value of the second reference voltage signal Vref2, the second comparator 332 determines that the voltage value of the voltage drop signal V1 is greater than the voltage value of the first reference voltage signal Vref1 throughout the predetermined period and that the common electrode wiring 2 has a short circuit.

Furthermore, the short circuit determination module 3 further includes a diode D that is connected in parallel with the second resistor R2, in which an anode of the diode D is connected with the first terminal of the capacitor C. When the switching unit 32 disconnects the subtraction unit 31 from the first comparator 331, the capacitor C begins discharging, and the diode D is used to accelerate the discharge rate of the capacitor C.

Figure 3:
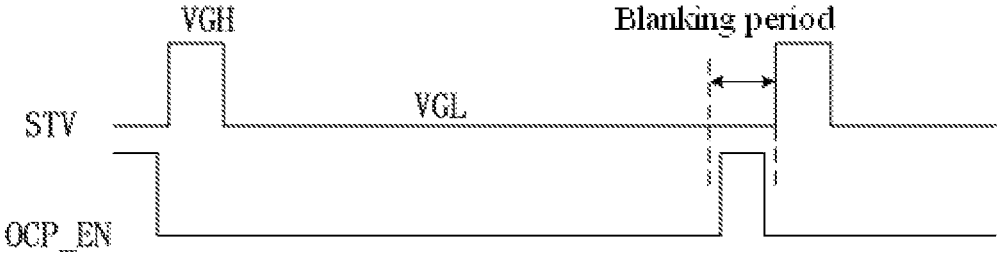
FIG. 3 is a sequential diagram of a scan activation signal and an enable signal of an LCD panel according to one embodiment of the present invention.

Furthermore, as shown in FIG. 3, the switching unit 32 is an N-channel TFT, and the enable signal OCP_EN is at high level VGH in the blanking period of the LCD panel and is at low level VGL in the scanning period of the LCD panel. The blanking period of the LCD panel means a period before the LCD panel starts scanning. As can be seen in FIG. 3, the blanking period is a period before the scan activation signal STV rises to the high level VGH.

In general, the LCD panel starts scanning when the scan activation signal STV rises to the high level VGH. After each scanning period of the LCD panel ends, a non-scanning period is between the scanning period and a next scanning period, and such non-scanning period is the blanking period.

Furthermore, the enable signal OCP_EN is outputted by an over-current protection circuit 4 that is connected with the common electrode wiring 2.

Furthermore, the predetermined period is at a range of 150 μs to 300 μs.

The present invention further provides a method for detecting a short circuit of a common electrode wiring 2. The method is applied in the above-mentioned circuit for detecting a short circuit of a common electrode wiring and includes the following steps.

The short circuit determination module 3 receives and performs a difference processing on the first voltage signal VCOM outputted by the common electrode wiring 2 and the second voltage signal VCOM_FB from the first resistor R1 to generate the voltage drop signal V1, in which the second voltage signal VCOM_FB is outputted by the first voltage signal VCOM via the first resistor R1.

The short circuit determination module 3 compares the voltage drop signal V1 with the first reference voltage signal Vref1 in a blanking period of an LCD panel; the short circuit determination module 3 determines that the common electrode wiring 2 has a short circuit if a voltage value of the voltage drop signal V1 is greater than a voltage value of the first reference voltage signal Vref1 throughout a predetermined period.

Furthermore, the short circuit determination module comparing the voltage drop signal with a first reference voltage signal and determining that the common electrode wiring has a short circuit if a voltage value of the voltage drop signal is greater than a voltage value of the first reference voltage signal throughout a predetermined period includes the following steps.

The enable signal OCP_EN is outputted to the switching unit 32 that is connected between the subtraction unit 31 and the first comparator 331, and the subtraction unit 31 is connected with the first comparator 331 by controlling the switching unit 32 in the blanking period of the LCD panel.

The first comparator 331 receives the voltage drop signal V1 from the subtraction unit 31 and compares the voltage drop signal V1 with the first reference voltage signal Vref1; the first comparator 331 outputs a low level signal if the voltage value of the voltage drop signal V1 is smaller or equal to the voltage value of the first reference voltage signal Vref1; the first comparator 331 outputs the third voltage signal V2 of high level to charge the capacitor C if the voltage value of the voltage drop signal V1 is greater than the voltage value of the first reference voltage signal Vref1.

The second comparator 332 compares the fourth voltage signal V3 outputted by the capacitor C with the second reference voltage signal Vref2; the second comparator 332 determines that the voltage value of the voltage drop signal V1 is greater than the voltage value of the first reference voltage signal Vref1 throughout the predetermined period and that the common electrode wiring 2 has a short circuit if a voltage value of the fourth voltage signal V3 is greater than a voltage value of the second reference voltage signal Vref2 after the capacitor C is charged in the predetermined period.

Furthermore, the predetermined period is at a range of 150 μs to 300 μs. In general, the blanking period of the LCD panel is 300 μs.

In summary, in the embodiments of the present invention, the voltage drop value of the first voltage signal VCOM that is outputted from the output terminal of the common electrode wiring 2 and through the first resistor R1 is detected in the blanking period of the LCD panel, and the voltage drop value is compared with the voltage value of the first reference voltage signal Vref1 to determine if the voltage drop value is greater than the voltage value of the first reference voltage signal Vref1 throughout the predetermined period; if yes, the common electrode wiring 2 is determined to have a short circuit. In the embodiments of the present invention, the common electrode wiring 2 is detected in the blanking period, such that interference on data lines and gate lines in the scanning period of the LCD panel and effects of drain currents of the TFTs in the LCD panel can be avoided. Therefore, when the common electrode wiring 2 has a short circuit, a triggered over-current protection on the common electrode wiring 2 can be accurately detected.

Furthermore, a de-noising technique is applied in the embodiments of the present invention. That is, after the capacitor C is charged in the predetermined period, the second comparator 332 compares the voltage value of the fourth voltage signal V3 with the voltage value of the second reference voltage signal Vref2, and thus a short circuit of the common electrode wiring 2 can be efficiently detected without being interfered by an over-current protection based on a spike that may cause false triggering. A short circuit with a current small than 10 mA can also be detected, which improves the conventional method for detecting a short circuit with a 100 mA degree circuit by 10 times.

The foregoing contents are detailed description of the disclosure in conjunction with specific preferred embodiments and concrete embodiments of the disclosure are not limited to these description. For the person skilled in the art of the disclosure, without departing from the concept of the disclosure, simple deductions or substitutions can be made and should be included in the protection scope of the application.

What is claimed is:

1. A circuit for detecting a short circuit of a common electrode wiring, the circuit applied in a liquid crystal display (LCD) panel and comprising a power management integrated circuit and a first resistor, wherein the power management integrated circuit comprises a common electrode wiring, a subtractor, a switch, and a comparison circuit;

an output terminal of the common electrode wiring is connected with a first terminal of the first resistor and a first input terminal of the subtractor, a second terminal of the first resistor is connected with a second input terminal of the subtractor, and thereby the first resistor is connected between the first input terminal of the subtractor and the second input terminal of the subtractor;

the subtractor is configured to receive a first voltage signal from the first input terminal of the subtractor connected with the first input terminal of the first resistor and a second voltage signal from the second input terminal of the subtractor connected with the second input terminal of the first resistor, perform a difference processing on the first voltage signal and the second voltage signal to obtain a voltage drop signal, and output the voltage drop signal from an output terminal of the subtractor;

the switch is connected between the output terminal of the subtractor and an input terminal of the comparison circuit, and configured to conduct the output terminal of the subtractor with the comparison circuit according to an enable signal in a blanking period of the LCD panel and make the output terminal of the subtractor and the comparison circuit in a scanning period of the LCD panel be non-conducted;

the comparison circuit is configured to compare the voltage drop signal with a first reference voltage signal to thereby determine the common electrode wiring whether has a short circuit or not; and a voltage value of the voltage drop signal is a voltage drop of the first voltage signal after passing through the first resistor.

2. The circuit according to claim 1, wherein the comparison circuit comprises a first comparator, a second comparator, a second resistor and a capacitor;

a first input terminal of the first comparator is connected to the output terminal of the subtractor via the switch to receive the voltage drop signal, and a second input terminal of the first comparator is connected to receive the first reference voltage signal;

an output terminal of the first comparator is connected with a first terminal of the capacitor and a first input terminal of the second comparator via the second resistor, a second terminal of the capacitor is grounded, and a second input terminal of the second comparator is connected to receive a second reference voltage signal;

the first comparator is configured to compare the voltage drop signal with the first reference voltage signal; if a voltage value of the voltage drop signal is less than or equal to a voltage value of the first reference voltage signal, the first comparator outputs a low level signal from the output terminal of the first comparator; if the voltage value of the voltage drop signal is greater than the voltage value of the first reference voltage signal, the first comparator outputs a third voltage signal of high level from the output terminal of the first comparator to charge the capacitor;

the second comparator is configured to compare a fourth voltage signal outputted by the capacitor with the second reference voltage signal; after the capacitor is charged in a predetermined period, if a voltage value of the fourth voltage signal is greater than a voltage value of the second reference voltage signal, the second comparator determines that the voltage value of the voltage drop signal is greater than the voltage value of the first reference voltage signal throughout the predetermined period and that the common electrode wiring has a short circuit.

3. The circuit according to claim 2, wherein the comparison circuit further comprises a diode that is connected in parallel with the second resistor, an anode of the diode is connected with the first terminal of the capacitor, and thereby the diode and the second resistor are connected in parallel between the output terminal of the first comparator and the first input terminal of the second comparator.

4. The circuit according to claim 1, wherein the switch is an N-channel thin film transistor (TFT), and the enable signal is at a high level in the blanking period of the LCD panel and is at a low level in the scanning period of the LCD panel.

5. The circuit according to claim 1, wherein the enable signal is outputted by an over-current protection circuit that is connected with the common electrode wiring.

6. The circuit according to claim 2, wherein the predetermined period is at a range of 150 μs to 300 μs.

7. The circuit according to claim 1, the first input terminal of the subtractor is a positive input terminal, and the second input terminal of the subtractor is a negative input terminal.

8. A circuit for detecting a short circuit of a common electrode wiring, the circuit applied in an LCD panel and comprising a power management integrated circuit and a first resistor, wherein the power management integrated circuit comprises a common electrode wiring, a subtractor, a switch, and a comparison circuit;

wherein an output terminal of the common electrode wiring is connected with a first terminal of the first resistor and a first input terminal of the subtractor, a second terminal of the first resistor is connected with a second input terminal of the subtractor, and thereby the first resistor is connected between the first input terminal of the subtractor and the second input terminal of the subtractor;

the subtractor is configured to receive a first voltage signal from the first input terminal of the subtractor connected with the first input terminal of the first resistor and a second voltage signal from the second input terminal of the subtractor connected with the second input terminal of the first resistor, perform a difference processing on the first voltage signal and the second voltage signal to obtain a voltage drop signal, and output the voltage drop signal from an output terminal of the subtractor;

the switch is connected between the output terminal of the subtractor and an input terminal of the comparison circuit, and configured to conduct the output terminal of the subtractor with the comparison circuit according to an enable signal in a blanking period of the LCD panel and make the output terminal of the subtractor and the comparison circuit in a scanning period of the LCD panel be non-conducted;

the comparison circuit is configured to compare the voltage drop signal with a first reference voltage signal; if a voltage value of the voltage drop signal is greater than a voltage value of the first reference voltage signal throughout a predetermined period, the comparison circuit short circuit determination module determines that the common electrode wiring has a short circuit;

wherein the predetermined period is at a range of 150 μs to 300 μs.

9. The circuit according to claim 8, wherein the comparison circuit comprises a first comparator, a second comparator, a second resistor and a capacitor;

a first input terminal of the first comparator is connected to the output terminal of the subtractor via the switch to receive the voltage drop signal, and a second input terminal of the first comparator is connected to receive the first reference voltage signal;

an output terminal of the first comparator is connected with a first terminal of the capacitor and a first input terminal of the second comparator via the second resistor, a second terminal of the capacitor is grounded, and a second input terminal of the second comparator is connected to receive a second reference voltage signal;

the first comparator is configured to compare the voltage drop signal with the first reference voltage signal; if the voltage value of the voltage drop signal is less than or equal to the voltage value of the first reference voltage signal, the first comparator outputs a low level signal from the output terminal of the first comparator; if the voltage value of the voltage drop signal is greater than the voltage value of the first reference voltage signal, the first comparator outputs a third voltage signal of high level from the output terminal of the first comparator to charge the capacitor;

the second comparator is configured to compare a fourth voltage signal outputted by the capacitor with a second reference voltage signal; after the capacitor is charged in the predetermined period, if a voltage value of the fourth voltage signal is greater than a voltage value of the second reference voltage signal, the second comparator determines that the voltage value of the voltage drop signal is greater than the voltage value of the first reference voltage signal throughout the predetermined period and that the common electrode wiring has a short circuit.

10. The circuit according to claim 9, wherein the comparison circuit further comprises a diode that is connected in parallel with the second resistor, an anode of the diode is connected to the first terminal of the capacitor, and thereby the diode and the second resistor are connected in parallel between the output terminal of the first comparator and the first input terminal of the second comparator.

11. The circuit according to claim 8, wherein the switch is an N-channel TFT, the enable signal is at a high level in the blanking period of the LCD panel and is at a low level in the scanning period of the LCD panel.

12. The circuit according to claim 8, wherein the enable signal is outputted by an over-current protection circuit that is connected with the common electrode wiring.

13. A method for detecting a short circuit of a common electrode wiring, the method comprising the following steps:

subtractor receiving a first voltage signal outputted by the common electrode wiring connected with a first terminal of a first resistor and a second voltage signal from a second terminal of the first resistor, through a first input terminal and a second input terminal of the subtractor respectively; and further performing a difference processing on the first voltage signal and the second voltage signal to obtain a voltage drop signal and outputting the voltage drop signal from an output terminal of the subtractor, wherein the first resistor is connected between the first input terminal of the subtractor and the second input terminal of the subtractor;

outputting an enable signal to a switch that is connected between the output terminal of the subtractor and an input terminal of a comparison circuit, and conducting the output terminal of the subtractor with the comparison circuit in a blanking period of a liquid crystal display (LCD) panel by controlling the switch;

the comparison circuit comparing the voltage drop signal with a first reference voltage signal in the blanking period of the LCD panel and determining that the common electrode wiring has a short circuit if the voltage value of the voltage drop signal is greater than a voltage value of the first reference voltage signal throughout a predetermined period.

14. The method according to claim 13, wherein the comparison circuit comparing the voltage drop signal with a first reference voltage signal in the blanking period of the LCD panel and determining that the common electrode wiring has a short circuit if the voltage value of the voltage drop signal is greater than a voltage value of the first reference voltage signal throughout a predetermined period comprises the following steps:

a first comparator receiving the voltage drop signal from the subtractor via the switch and the first reference voltage signal through two input terminals of the first comparator respectively and comparing the voltage drop signal with the first reference voltage signal; the first comparator outputting a low level signal if the voltage value of the voltage drop signal is smaller or equal to the voltage value of the first reference voltage signal; the first comparator outputting a third voltage signal of high level to charge a capacitor through a second resistor if the voltage value of the voltage drop signal is greater than the voltage value of the first reference voltage signal; and a second comparator receiving a fourth voltage signal outputted by the capacitor and a second reference voltage signal through two input terminals of the second comparator respectively, and comparing the fourth voltage signal with the second reference voltage signal; after the capacitor is charged in the predetermined period, the second comparator determining that the voltage value of the voltage drop signal is greater than the voltage value of the first reference voltage signal throughout the predetermined period and that the common electrode wiring has a short circuit if a voltage value of the fourth voltage signal is greater than a voltage value of the second reference voltage signal.

15. The method according to claim 14, wherein the predetermined period is at a range of 150 μs to 300 μs.

* * * * *